US009513015B2

(12) United States Patent
Estrella et al.

(10) Patent No.: US 9,513,015 B2
(45) Date of Patent: Dec. 6, 2016

(54) OVEN WITH CONTROL PANEL COOLING SYSTEM

(71) Applicants: Miguel Estrella, Bellflower, CA (US); Michael Khandros, North Hollywood, CA (US)

(72) Inventors: Miguel Estrella, Bellflower, CA (US); Michael Khandros, North Hollywood, CA (US)

(73) Assignee: Dacor, City of Industry, CA (US)

( * ) Notice: Subject to any disclaimer, the term of this patent is extended or adjusted under 35 U.S.C. 154(b) by 246 days.

(21) Appl. No.: 14/309,512

(22) Filed: Jun. 19, 2014

(65) Prior Publication Data

US 2015/0369491 A1 Dec. 24, 2015

(51) Int. Cl.
*F24C 15/00* (2006.01)
*F24C 7/08* (2006.01)

(52) U.S. Cl.
CPC ..... *F24C 15/006* (2013.01); *F24C 7/085* (2013.01); *F24C 7/086* (2013.01)

(58) Field of Classification Search
CPC ..... F24C 15/00
USPC ..... 126/21 A
See application file for complete search history.

(56) References Cited

U.S. PATENT DOCUMENTS

| | | | | |
|---|---|---|---|---|
| 3,121,158 | A | 2/1964 | Hurko | |
| 3,310,046 | A | 3/1967 | Scott et al. | |
| 3,889,099 | A | 6/1975 | Nuss | |
| 4,601,279 | A * | 7/1986 | Guerin | F24C 14/02 126/21 A |
| 4,865,010 | A | 9/1989 | Kett | |
| 6,097,000 | A | 8/2000 | Frasnetti et al. | |
| 7,228,857 | B2 | 6/2007 | Kim et al. | |
| 7,655,885 | B2 | 2/2010 | Kim et al. | |
| 7,686,009 | B2 | 3/2010 | Park et al. | |
| 7,703,451 | B2 | 4/2010 | Bang | |
| 7,721,728 | B2 | 5/2010 | Kim et al. | |
| 7,856,973 | B2 | 12/2010 | Kim et al. | |
| 8,333,183 | B2 | 12/2012 | Nam et al. | |
| 8,334,482 | B2 | 12/2012 | Nam et al. | |
| 2007/0131220 | A1 | 6/2007 | Kim et al. | |
| 2007/0158328 | A1 | 7/2007 | Kim et al. | |
| 2008/0184984 | A1 | 8/2008 | Elkasevic | |
| 2009/0194090 | A1 | 8/2009 | Kim et al. | |
| 2010/0065035 | A1 * | 3/2010 | Armstrong | F24C 15/006 126/198 |
| 2010/0065036 | A1 * | 3/2010 | Watkins | F24C 15/006 126/21 A |
| 2011/0214661 | A1 | 9/2011 | Hyun et al. | |
| 2013/0277353 | A1 | 10/2013 | Joseph et al. | |

* cited by examiner

*Primary Examiner* — Avinash Savani
(74) *Attorney, Agent, or Firm* — Guy L. Cumberbatch; Mark A. Goldstein; SoCal IP Law Group LLP

(57) ABSTRACT

A cooking oven controlled by an included retail-grade control device having a capacitive glass touchscreen and running a specialized cooking and controlling app, such as an Android tablet. A cooling system for the oven provides a reverse air flow cooling system that pulls air in from the top front of the oven rather than pushing it out. A single cooling fan provides adequate cooling to the control device, as well as providing cooling to a front door of the oven and also convective flow through the heating chamber. The control device is mounted in an upper control bezel which has a series of lateral air intake openings on a rear wall. The cooling fan actively cools the control device by pulling air into the intake openings and through a lower exhaust opening.

24 Claims, 8 Drawing Sheets

OVEN WITH CONTROL PANEL COOLING SYSTEM

FIELD OF THE INVENTION

This invention relates to ovens with touch screen control panels and, more particularly, to an efficient cooling system for such control panels.

BACKGROUND OF THE DISCLOSURE

Ovens may be electric or gas powered and may include a convection component. Convection ovens include one or more fans, typically in the rear of the heating chamber, that circulate air within the heating chamber to create convection currents.

Oven cooling systems rely on one or more internal fans to convectively cool the area around the control electronics as well as around the front door, to enable a user to open the door without danger of being burned. One form of oven cooling system features an internal fan that pulls air past areas that require convective cooling and pushes the heated air out of the front of the oven above the door, which can be uncomfortable especially in hot climates. For instance, U.S. Pat. No. 4,865,010 to the Whirlpool Corp. has a fan mounted centrally above the insulated cooking chamber which pulls heated air and mixes it with ambient air, then exhausts the mixed air out the front top of the oven. U.S. Pat. No. 7,856,973 to LG Electronics, Inc. also includes an upper front exhaust. Another configuration of oven cooling system blows the hot exhaust air downward rather than out the top front of the oven. For instance, U.S. Pat. No. 7,686,009 to LG Electronics, Inc. blows the hot air down through the door. Dacor® Appliances of Industry, CA has a line of ovens with a reverse air flow cooling system that pulls air in from the front of the oven above the door and ports it out from the bottom, which keeps the oven door temperature comfortable to touch and avoids hot air being blown directly toward the user. In some ovens the same fan used to create convective flow within the cooking chamber is also used for cooling other areas of the oven.

Conventional ovens often have control panels that are on the front of the oven just above the door. Modern ovens have begun to incorporate sophisticated LCD displays in the control panels with capacitive glass touchscreens that are susceptible to damage from overheating. The sensitive electronics are especially vulnerable during the self-cleaning cycle of an oven when the interior temperature can reach up to 900° F.

Despite the long history of oven design, there is a need for an enhanced cooling system that will protect the sensitive electronics more regularly found in modern ovens, and in particular a cooling system that does not add to the cost of the oven such as, for example, adding a fan dedicated to cooling the electronic components.

SUMMARY OF THE INVENTION

In accordance with one embodiment, the present application discloses an oven having a control panel cooling system, the oven including a housing having a front and rear and defining within a first insulated heating chamber having a front door therefor. The front door has an air flow channel extending from an opening in a lower edge to an opening in an upper edge. A main air intake channel commences at an opening toward the front of the housing and adjacent the opening in the upper edge of the door and extends to the rear of the housing. A control panel bezel mounts above the front door and encloses therein electronics for the oven including on a front face thereof an LCD display with a capacitive glass touchscreen. A secondary air intake channel commences at a lower exhaust opening in a rear wall of the control panel bezel and extending to the rear of the housing. An air exhaust channel opens to an outlet of the cooling fan and has an exit from the housing located at a bottom of the housing. A first cooling fan mounted within the rear of the housing outside of the first heating chamber is arranged to pull air from both the main and secondary air intake channels and push air through the air exhaust channel and out of the exit so as to cool both the door and the electronics in the control panel bezel. Desirably, the electronics for the oven comprises retail-grade electronics for a standard tablet computer.

The exemplary control panel bezel has upper air intake openings on both lateral sides of the rear wall. The lower air exhaust opening may be centrally located in the rear wall so that the air flow through the bezel commences at the upper lateral air intake openings and travels down and toward the center of the bezel. The control panel bezel may also have two other lower air exhaust openings in the rear wall to one side of the central lower air exhaust opening, and the oven housing defines a horizontal manifold that has a relatively wide mouth adjacent the exhaust openings and narrows toward the rear and the cooling fan, the manifold defining the secondary air intake channel.

The exemplary heating chamber may include convective flow outlets that open into the main air intake channel so that the cooling fan also pulls convective flow through the heating chamber. In some embodiments, the housing also contains a second insulated heating chamber stacked below the first heating chamber, and the oven includes a second cooling fan mounted within the rear of the housing in a rear space open to a middle space defined between the first and second heating chambers. The second cooling fan is arranged to pull air both through the middle space and from the outlet of the first cooling fan mounted thereabove.

In a second embodiment, an oven having a control panel cooling system comprises an oven including a housing defining within a first insulated heating chamber having a front door therefor, the front door having a door air flow path extending from an opening in a lower edge to an opening in an upper edge. A control panel bezel mounts above the door and encloses therein electronics for the oven including on a front face thereof an LCD display with a capacitive glass touchscreen. The control panel bezel further has air intake openings and an air exhaust opening spaced therefrom defining a control panel bezel air flow path therebetween. An inlet of a first cooling fan mounted within and to the rear of the housing outside of the heating chamber communicates with separate air intake channels within the housing that converge and are arranged to pull air separately through both the door air flow path and control panel bezel air flow path. Finally, an air exhaust channel opens to an outlet of the cooling fan and has an exit from the housing. Desirably, the electronics for the oven comprises retail-grade electronics for a standard tablet computer.

The exemplary control panel bezel has upper air intake openings on both upper lateral sides of a rear wall thereof. The air exhaust opening of the control panel bezel is preferably centrally located in a lower portion of the rear wall so that the air flow through the bezel commences at the upper lateral air intake openings and travels down and toward the center of the bezel. The control panel bezel also may have two other lower air exhaust openings in the rear wall to one side of the central lower air exhaust opening, and the oven housing defines a horizontal manifold that has a relatively wide mouth adjacent the exhaust openings and narrows toward the rear and the cooling fan.

In the second embodiment, the heating chamber may include convective flow outlets that open into a flow channel above the heating chamber that is open to the door air flow path so that the cooling fan also pulls both convective flow through the heating chamber and cooling flow through the door air flow path. The housing also may contain a second insulated heating chamber stacked below the first heating chamber and having a second door with a second door air flow path. A second cooling fan mounted within the rear of the housing in a rear space opens to a middle space defined between the first and second heating chambers, the middle space being open to the second door air flow path such that the second cooling fan is arranged to pull air both through the middle space and from the outlet of the first cooling fan mounted thereabove.

A third embodiment of an oven having a control panel cooling system, comprising an oven including a housing defining within at least one insulated heating chamber having a front door therefor. A control panel bezel mounted above the door encloses retail-grade electronics for the oven including on a front face thereof a LCD display and capacitive glass touchscreen and corresponding circuitry. The control panel bezel has upper air intake openings on both lateral sides of a rear wall thereof and an air exhaust opening in the rear lower wall of the control panel bezel defining a control panel bezel air flow path therebetween. A first cooling fan mounts within and to the rear of the housing outside of the heating chamber. An air intake channel commences at the air exhaust opening of the control panel bezel and extends to an inlet of the cooling fan, and air exhaust channel opens to an outlet of the cooling fan and has an exit from the housing located at a bottom of the housing. Consequently, operation of the fan pulls air through the air flow path of the control panel bezel and through the air intake channel, and pushes air through the air exhaust channel and out of the exit so as to cool the electronics in the control panel bezel. The retail-grade electronics for the oven may comprise components from a standard retail Android tablet.

The air exhaust opening of the control panel bezel is desirably centrally located in the rear wall so that the air flow through the bezel commences to the upper lateral sides and travels down and toward the center of the bezel. The control panel bezel also preferably has two other lower air exhaust openings in the rear wall to one side of the central lower air exhaust opening, and the oven housing defines a horizontal manifold that has a relatively wide mouth adjacent the exhaust openings and narrows toward the rear and the cooling fan. The oven front door may have a door air flow path extending from an opening in a lower edge to an opening in an upper edge, and the first cooling fan is arranged to also pull air through the door air flow path. The heating chamber also may include convective flow outlets that open into a flow channel above the heating chamber that is open to the door air flow path so that the cooling fan also pulls both convective flow through the heating chamber and cooling flow through the door air flow path. The housing also may contain a second insulated heating chamber stacked below the first heating chamber and having a second door with a second door air flow path. The second cooling fan is mounted within the rear of the housing in a rear space open to a middle space defined between the first and second heating chambers, the middle space being open to the second door air flow path, and the second cooling fan is arranged to pull air both through the middle space and from the outlet of the first cooling fan mounted thereabove.

DETAILED DESCRIPTION OF THE PREFERRED EMBODIMENTS

Figure 1:
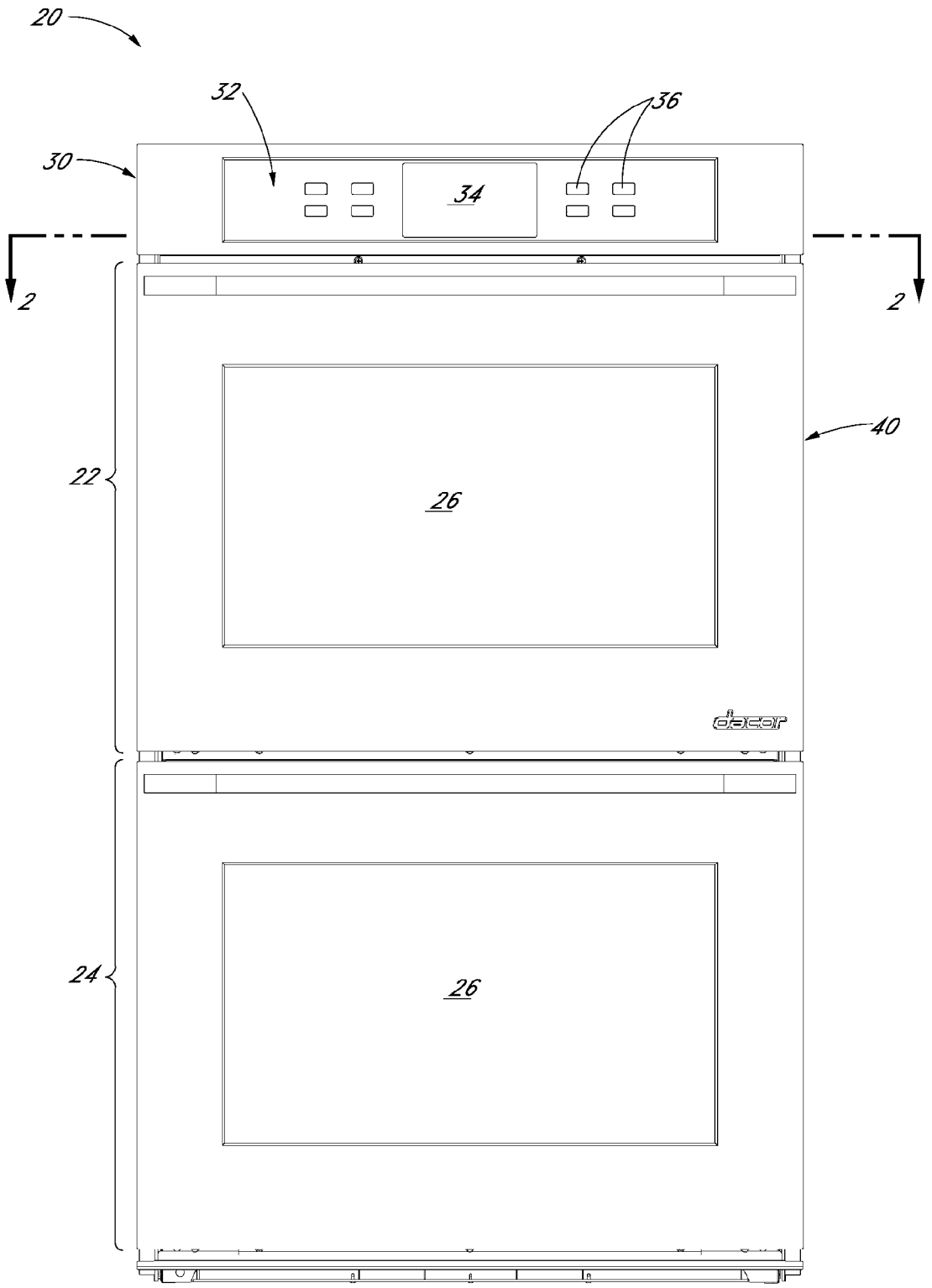
FIG. 1 is a front elevational view illustrating an exemplary cooking oven incorporating the advanced cooling system of the present application.

The present application discloses an enhanced cooking oven controlled by an included retail-grade control device running a specialized cooking and controlling app. The cooking oven may be electric or gas, with or without convection and have typical oven features having electronic hardware, software and a cooking and controlling application included. One suitable control device is an Android tablet or similar device which provides a user-interface in the way of a touch screen and suitable software. The Android software included in the oven is preferably a version of the Android operating system provided by Google, Inc. of Mountain View, Calif. (As of the time of the filing this patent application Google, Inc. has a pending application to register the Android trademark. As of the filing of this patent application, the Android name is not a registered trademark for software.) One such exemplary Android-controlled oven is disclosed in U.S. Patent Publication No. 2013/0277353 to Joseph, et al., filed Oct. 24, 2013, the disclosure of which is expressly incorporated by reference herein. It should be understood, however, that the control device and associated software could be any number of similar models, such as an Apple iPad or the like.

The present application discloses an advanced cooling system for conventional cooking ovens (electrical or gas) with a reverse air flow cooling system that pulls air in from the top front of the oven rather than pushing it out. Typically, the oven ports exhaust air out from the bottom of the oven, which keeps the oven door temperature comfortable to touch and avoids hot air being blown directly toward the user standing in front of the oven, however other exhaust configurations are possible. The cooling flow through the oven is sufficient to cool modern retail-grade electronic hardware in a controlled bezel at the upper front of the oven, such as the Android software disclosed in U.S. Patent Publication No. 2013/0277353. In particular, the cooling system effectively cools the sensitive electronics even during the self-cleaning cycle of the oven, which can reach 900° F.

The term, "retail-grade" means that the control device hardware is the same as is used in retail hand-held devices, such as a standard Android processor and associated circuits, including a standard capacitive glass touch screen. Such retail-grade components are not designed to withstand extremely high temperatures, and most will function only up to a maximum temperature of about 140° F. (about 70° C.). On the other hand, industrial- or commercial-grade devices are available that can withstand even higher temperatures. Such commercial-grade devices often have enhanced insulation, special high-temperature solders and the like. Though such non-retail grade components could be used, they are more expensive and thus drive the overall cost of the oven up markedly. For the consumer market, the present application describes a cooling system that permits the use of retail-grade components such as a standard Android control device to keep the price of the oven within reach of residential consumers.

Moreover, the cooling system accomplishes the necessary cooling with only the cooling fan used for the heating chamber. This avoids the additional cost and complexity of a secondary fan and provides a more controlled air flow system. If the oven has a single heating chamber, there is a single cooling fan, whereas a double heating chamber will have just two fans. Therefore, the exemplary cooling system utilizes no more than one fan per heating chamber.

Figure 3:
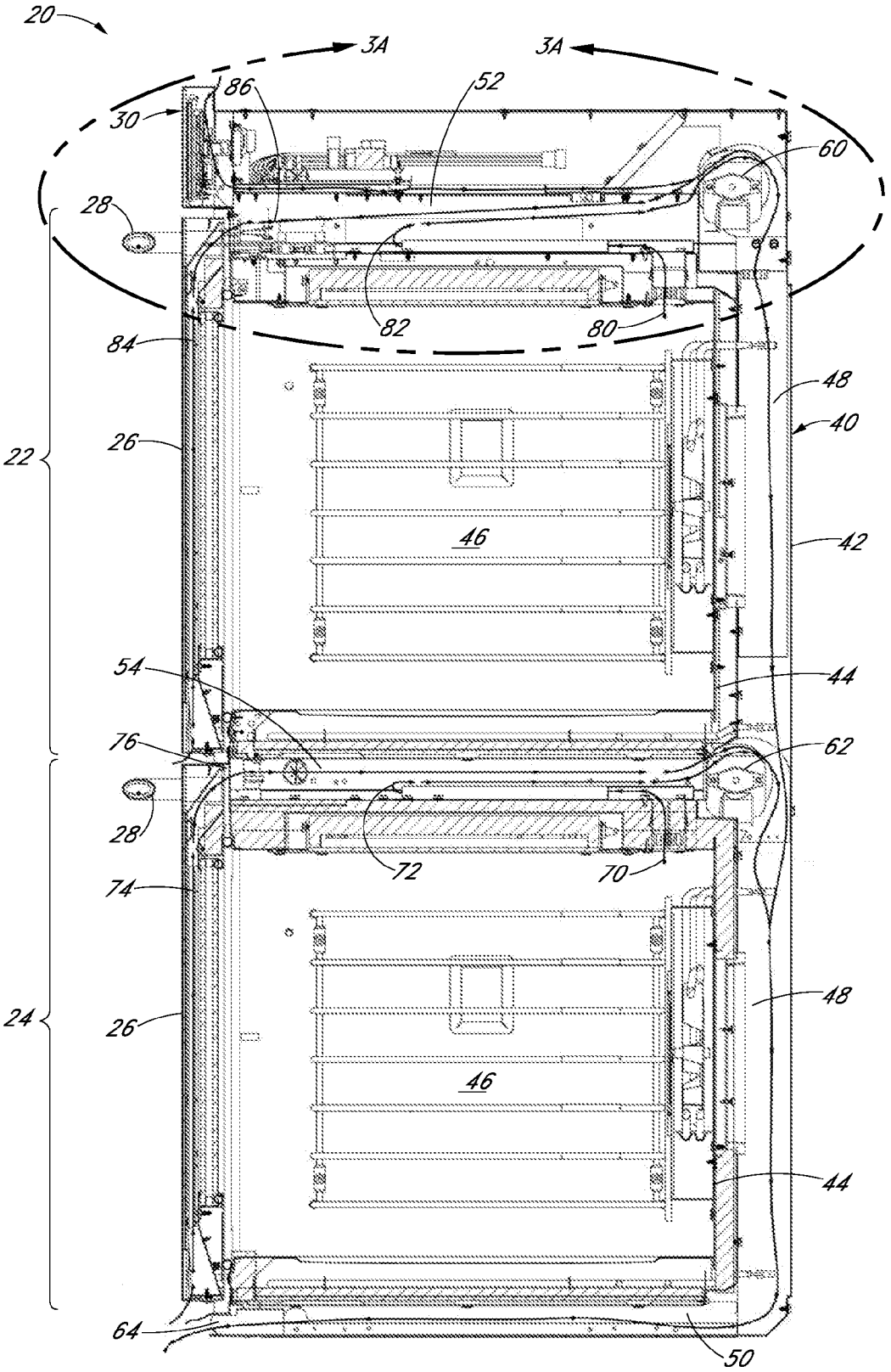
FIG. 3 is a vertical sectional view of the exemplary cooking oven taken along broken line 3-3 in FIG. 2 showing an oven housing defining two vertically stacked heating chambers each having a cooling fan associated therewith and indicating the general cooling air flow through the oven housing and around the heating chambers.

With reference now to FIGS. 1 and 3, an exemplary cooking oven 20 incorporating the advanced cooling system of the present application is shown. The oven 20 has dual cooking chambers, with an upper cooking chamber 22 mounted above a lower cooking chamber 24. In the illustrated embodiments, and for the most part, the cooking chambers 22, 24 are substantially identical, and thus like parts will be given like element numbers. Each of the respective cooking chambers 22, 24 has a front door 26 that pivots outward about lower hinges (not shown) using a handle 28. A control panel bezel 30 mounted above the upper cooking chamber 22 includes a control panel 32 having a central display window 34 and a plurality of control buttons 36. The central display window 34 preferably includes a liquid crystal display with a capacitive glass touchscreen capability. The cooling system described herein maintains the temperature of at least the handles 28 of the front doors 26 low enough to avoid discomfort to the user. Furthermore, the cooling system maintains the temperature within the control panel bezel 30 below a threshold value which is considered necessary for proper functioning of the electronics therein. In one embodiment, the cooling system maintains the temperature within the control panel bezel 32 below about 110° F.

The term "control panel bezel" or simply "bezel" refers to that portion of the oven housing that encloses the control panel electronics, including the capacitive glass touchscreen. In the illustrated embodiment, the control panel bezel 30 comprises a generally rectangular box-shape formed by a plurality of walls of sheet metal have various openings for creating an air curtain for cooling and passage of wires and such. A "bezel" in one conventional sense refers to a rim surrounding a display area, such as the metallic rim surrounding the face of a watch. Indeed, FIG. 1 shows a solid metallic portion of the control panel bezel 30 surrounding the control panel 32. However, as used herein, the term "bezel" is deemed to be the three-dimensional portion of the housing within which the control panel electronics are mounted.

An oven housing 40 comprises numerous structural frame and inner and outer surface pieces, as will be described in some detail herein. In general, the term "housing" means the aggregate of structural components that define and support the insulated heating chamber(s) 22, 24. The housing 40 of each of the heating chambers 22, 24 includes a sheet metal outer enclosure 42.

Figure 2:
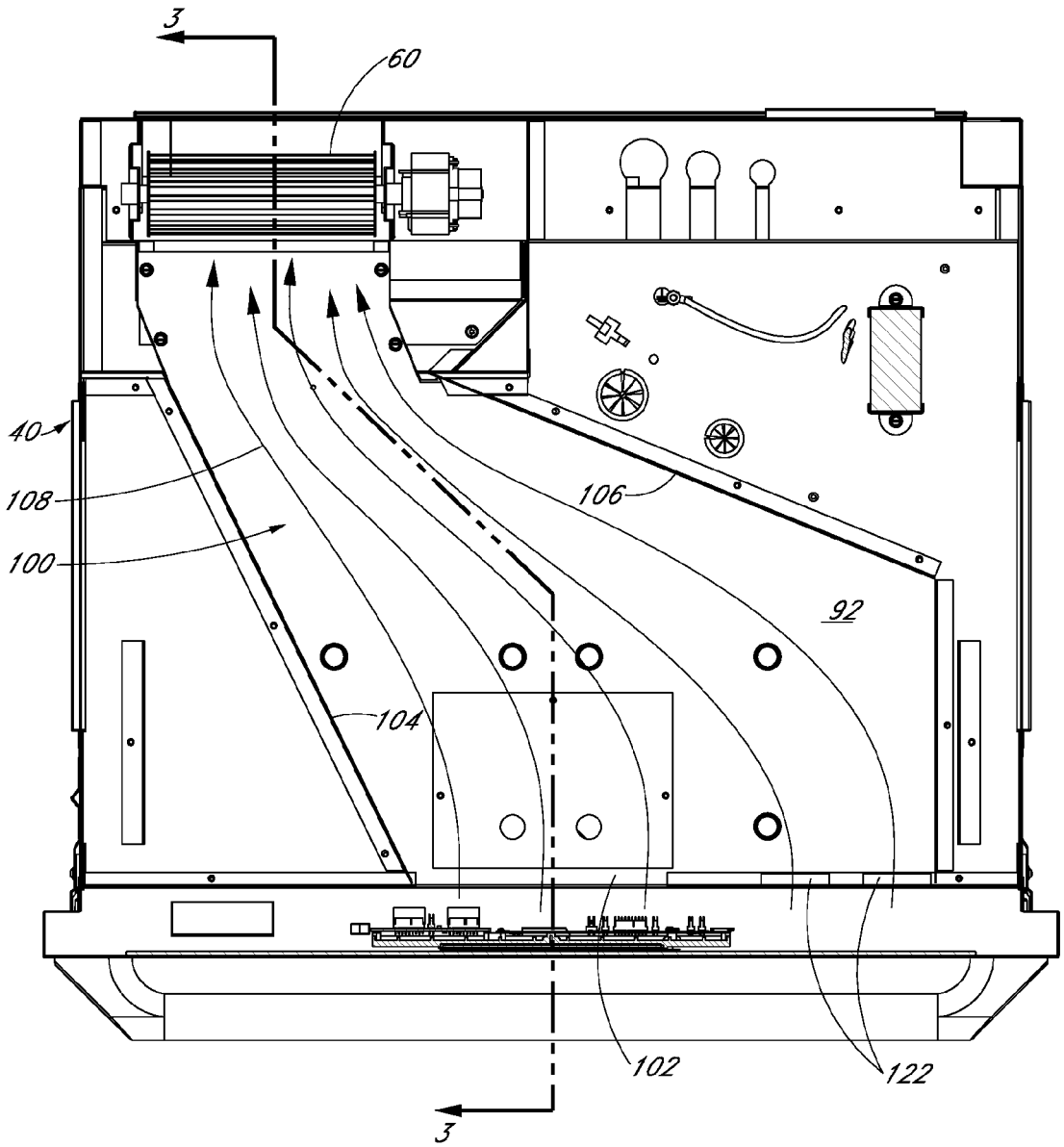
FIG. 2 is a horizontal sectional view taken along line 2-2 of FIG. 1 illustrating a preferred upper air intake channel leading from a control panel bezel to a cooling fan for the upper heating chamber.
Figure 2A:
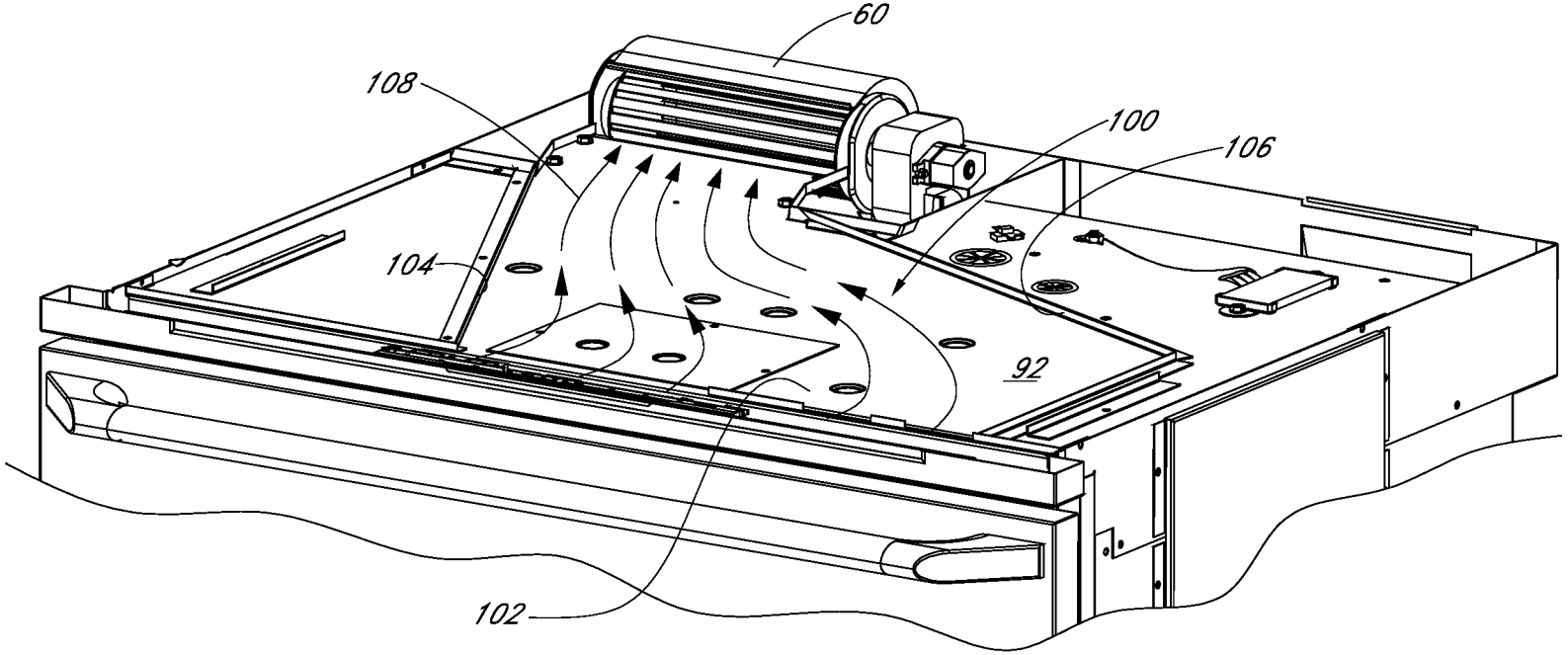
FIG. 2A is a view of the air intake channel from the control panel bezel to the upper cooling fan looking downward on the top of the oven with an upper housing panel removed.

FIG. 2 is a horizontal sectional view taken looking down along line 2-2 of FIG. 1 showing the top of the oven below a top panel of the outer enclosure 42, while FIG. 2A is a view of the same area looking downward on the top of the oven at an angle with the top panel of the outer enclosure 42 removed.

Now with reference to FIG. 3, a vertical sectional view of the exemplary cooking oven 20 illustrates the oven housing 40 surrounding and defining the two vertically stacked heating chambers 22, 24. As mentioned above, the two illustrated heating chambers 22, 24 are substantially the same size and have the same effective volume. However, it should be understood that the chambers 22, 24 may be dissimilar in size.

Still referring to FIG. 3, the housing 40 of each of the heating chambers 22, 24 includes the sheet metal outer enclosure 42 surrounding an insulated inner enclosure 44 within which is defined a cooking space 46. The outer enclosure 42 surrounds both inner enclosures 44, and is not interposed therebetween. The outer enclosure 42 is larger than the inner enclosures 44 so as to define spaces or offsets therebetween for insulation, cooling channels, and the mounting of various functional components. As seen in FIG. 3, a relatively wide rear space or offset 48 extends vertically the height of both of the heating chambers 22, 24, a lower space or offset 50 extends underneath the lower heating chamber, and a relatively tall upper space or offset 52 is created above the upper heating chamber. Although not shown in FIG. 3, side offsets are also provided between the outer and inner enclosures 42, 44. Furthermore, in the case of an oven having more than one heating chamber, such as shown, a middle offset 54 extends between the two inner enclosures 44.

As seen on the right side of FIG. 3, each of the heating chambers 22, 24 has a cooling fan 60, 62 associated therewith, and the general cooling air flow through the oven housing 40 and around the heating chambers 22, 24 is shown by flow arrows. More specifically, an upper cooling fan 60 associated with the upper heating chamber 22 mounts at the rear upper corner of the housing 40, generally at the intersection between the rear offset 48 and upper offset 52, and a lower cooling fan 62 associated with the lower heating chamber 24 mounts in the rear offset 48 at a location aligned with the middle offset 54. Both of the cooling fans 60, 62 pull air horizontally in a rearward direction from the front of the oven 20 and push air downward through the rear offset 48. The lower cooling fan 62 also receives air moving downward from the upper cooling fan 60 and pushes it further downward. Ultimately, the fans push the hot air to the bottom of the oven 20, wherein it is forced 90° and forward through the lower offset 50 or air exhaust channel toward an exit port 64 located at the bottom front of the housing 40. As mentioned above, there may be an alternative exit such as through a side port leading to a heat exhaust vent or other such accommodation.

In addition to providing cooling flow, the lower cooling fan 62 provides convective airflow within the heating space 46 of the lower heating chamber 24. More particularly, a flow arrow 70 is shown exiting from the rear upper region of the heating space 46. The air flows laterally in a forward direction through a sub-channel approximately half the total front-to-back dimension of the oven 20 and then turns 180° at 72 to continue rearward through the middle offset 54, toward the lower cooling fan 62. A majority of the middle offset 54 is open to provide good airflow therethrough. Air is also pulled through the middle offset 54 from spaces formed within the door 26 of the lower heating chamber 24. That is, upward flow arrows 74 are shown passing through the door 26 and then turning 90° to the rear at the middle offset 54. In this regard, vents (not shown) are provided in a front panel 76 of the housing 40 that otherwise covers and disguises the middle offset 54. Actuation of the lower cooling fan 62 creates a negative pressure differential in a rearward direction through the middle offset 54, which acts on and pulls the hot air rising through the door 26 of the lower heating chamber 24 into the middle offset toward the fan. In this way, the door 26 of the lower heating chamber 24 remains relatively cool so that the handle 28 can be grasped without discomfort.

The upper cooling fan 60 functions much in the same manner as the lower cooling fan 62 to cool spaces around the upper heating chamber 22. The fan 60 is also positioned to provide convective airflow within the heating space 46 of the upper chamber, as seen at flow arrows 80 and 82. Likewise, hot air rising through spaces in the door 26 as shown by arrow 84 is pulled in a rearward direction at 86 by the fan 60 so as to cool the door at its handle 28.

Figure 3A:
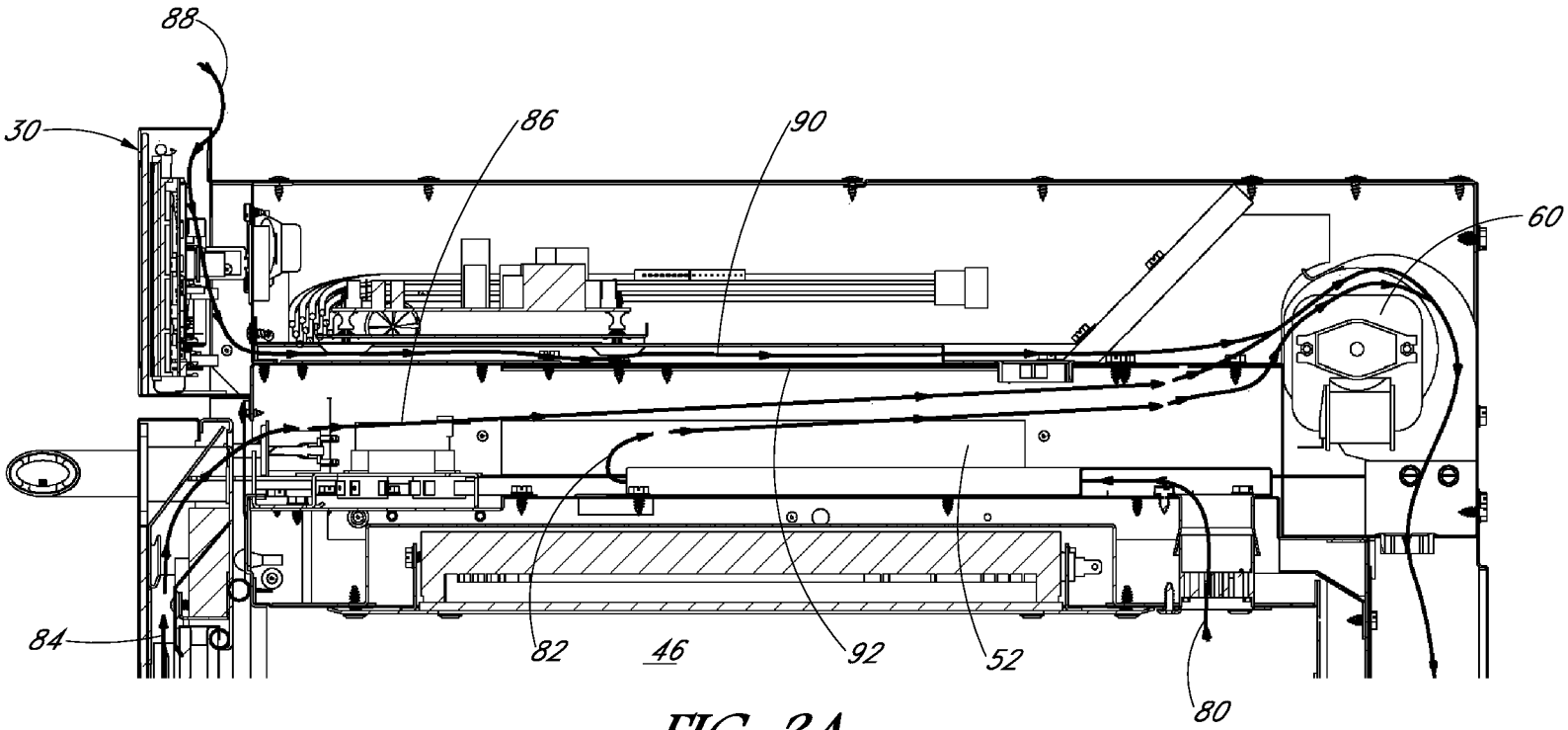
FIG. 3A is an enlarged upper portion of the vertical sectional view of FIG. 3 showing internal components and cooling flow paths in the upper air intake channel above an upper heating chamber.

In addition, the upper cooling fan 60 provides active cooling flow to the control panel bezel 30. With reference to FIG. 3A, a flow arrow 88 shown entering an upper end of the vessel 30 passes across the sensitive electronics therein and is pulled in a rearward direction at 90 toward the upper cooling fan 60. It is important to note that an internal panel 92 within the upper offset 52 separates the flow of hot air 86 from the upper door 26 and the convective flow 82 exiting the heating space 46 from the air flow 90 pulled through the control panel bezel 30. The upper offset 52 is thus divided into a main air intake channel below the internal panel 92 and a secondary air intake channel above it. The size of the main and secondary air intake channels as well as the position and strength of the upper cooling fan 60 have been calibrated such that sufficient cooling is provided to both the upper door 26 and control panel bezel 30. The main airflow channel generally extends from the upper end of the door 26 to the fan 60, while the secondary air intake channel extends generally from the bezel 30 to the fan 60.

The particular active flow passages through the bezel 30 will now be described with reference to all of FIGS. 2-8. As best seen in FIGS. 2 and 2A, the upper cooling fan 60 mounts at a rear left side of the housing 40. The secondary air intake channel is defined within a dogleg-shaped manifold 100 above the internal panel 92. The manifold 100 is in fluid communication with exhaust openings provided in the control panel bezel 30 at the front of the oven, and is also in fluid communication with an intake of the upper cooling fan 60. As seen in FIG. 2, the manifold 100 commences at a relatively wide front mouth 102 which is off-center to the right of the oven. A left border wall 104 of the manifold extends rearward at an angle toward the back left corner of the oven and terminates in the vicinity of the left side of the intake of the fan 60. A right border wall 106 of the manifold extends rearward for a short distance and then angles to the left before turning again to continue straight back toward the right side of the intake of the fan 60. The width of the intake of the fan 60 is somewhat smaller than the front mouth 102 of the manifold 100. The airflow generated by actuation of the fan 60 is shown by flow arrows 108 in both FIGS. 2 and 2A. In general, cooling air is collected from openings in the front bezel 30 that extend more than half the width thereof, the air then converging as indicated by arrows 108 in a rearward direction at the fan 60.

Figure 4:
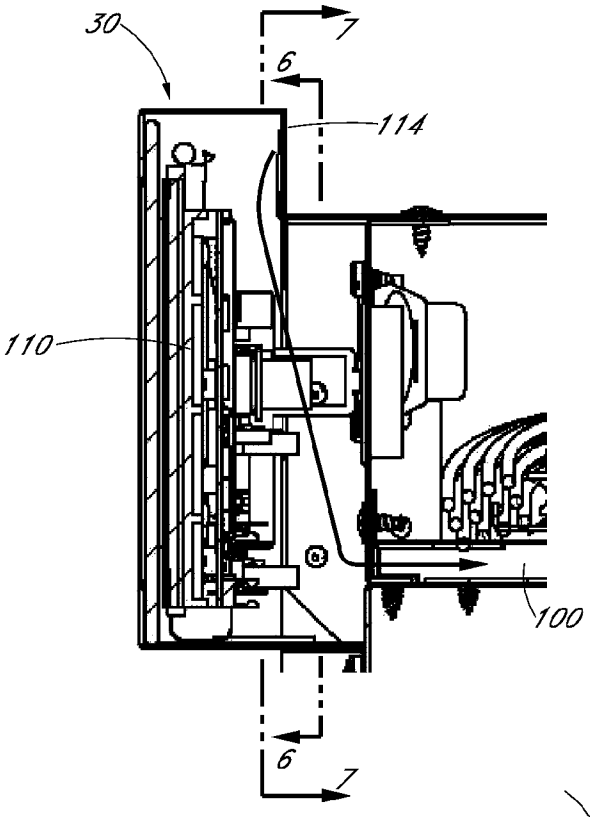
FIG. 4 is an enlarged portion of the vertical sectional view of FIG. 3A showing the control panel bezel and electronics therein.
Figure 5:
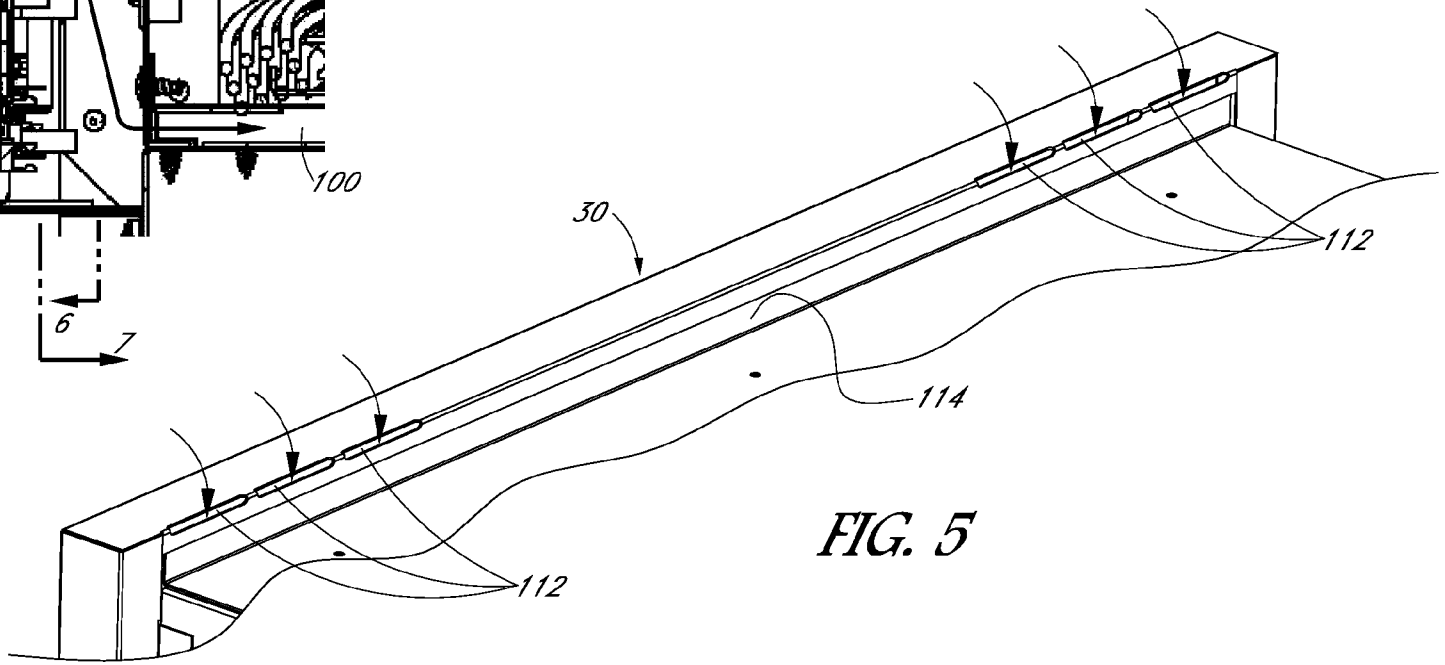
FIG. 5 is a perspective view of a rear upper edge of the control panel bezel having air intake openings on both lateral sides thereof.
Figure 6:
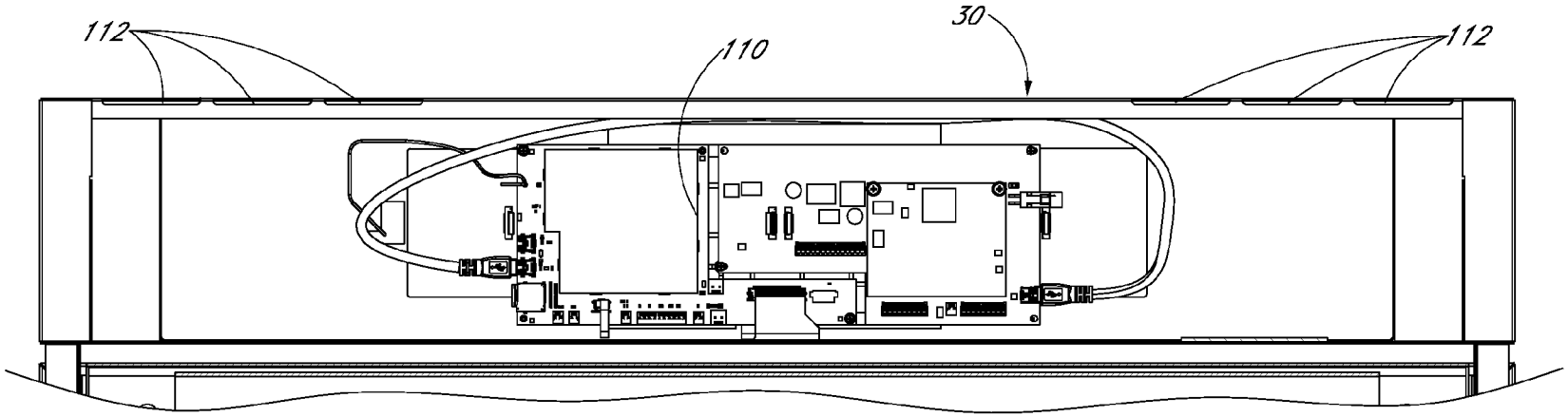
FIG. 6 is an elevational view taken along line 6-6 of FIG. 4 of the front wall of the control panel bezel looking forward from the inside of the bezel.
Figure 7:
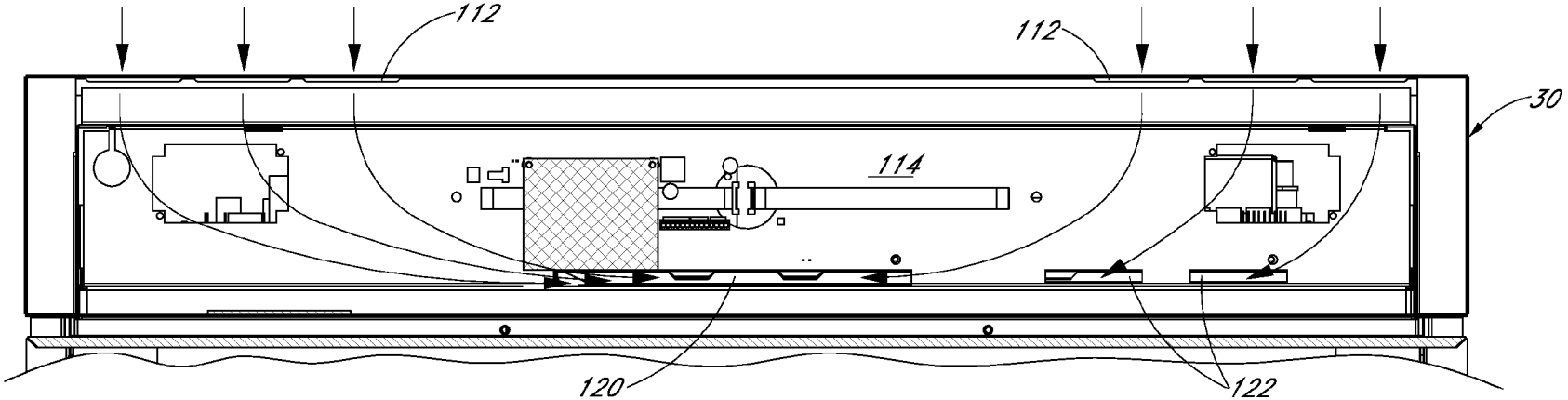
FIG. 7 is an elevational view taken along line 7-7 of FIG. 4 of the rear wall of the control panel bezel looking rearward from the inside of the bezel and showing an air flow path through the bezel.
Figure 8:
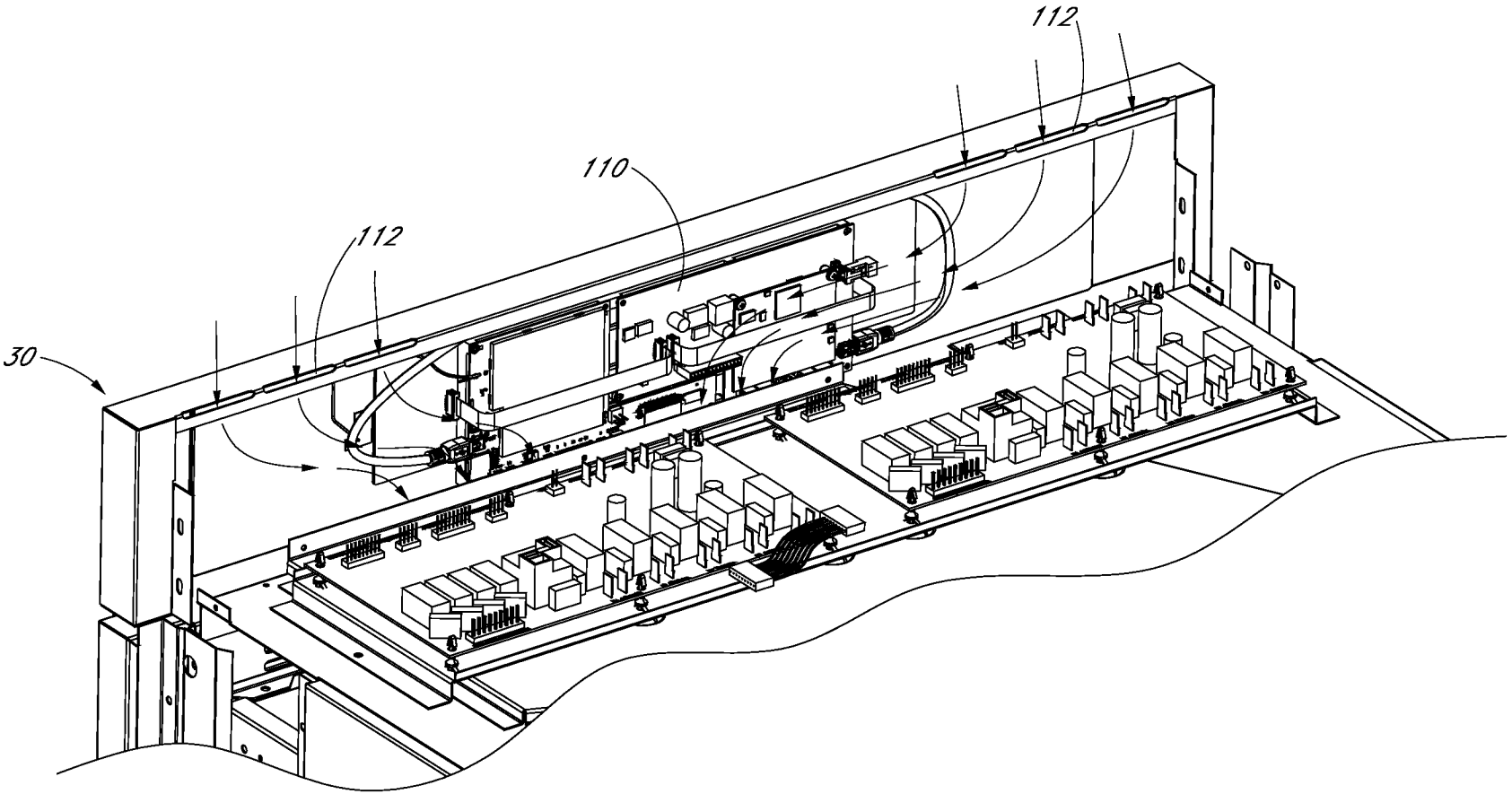
FIG. 8 is a perspective view looking at the rear of the control panel bezel with the rear wall removed to further illustrate the air flow path therethrough.

FIG. 4 is an enlarged portion of the vertical sectional view of FIG. 3A showing the control panel bezel 30 and electronics 110 including circuit boards therein. FIG. 5 shows a rear upper edge of the control panel bezel 30 having air intake openings 112 on both lateral sides thereof. FIG. 6 is taken along line 6-6 of FIG. 4 and shows the internal components of the control panel bezel looking forward from the rear. FIG. 7 is looking rearward along line 7-7 of FIG. 4 and showing a rear wall 114 of the control panel bezel 30 from the inside and an air flow path through the bezel. Finally, FIG. 8 illustrates the control panel bezel 30 with the rear wall 114 removed to further illustrate the air flow path therethrough.

As seen in FIG. 4, the active cooling airflow through the control panel bezel 36 generally a downward vertical path from an upper portion of the rear wall 114 until it enters the manifold 100. FIGS. 5, 7 and 8 show that the cooling airflow commences at the upper air intake openings 112 on both lateral sides of the rear wall 114 and moves inward as it is pulled downward through the bezel 30. The sensitive electronics 110 found within the control panel bezel 30 are generally concentrated in a middle portion thereof, as opposed to being placed at the lateral sides. This porting arrangement where the airflow starts at the outside and moves inward serves two purposes. First, the intake air through the openings 112 will be at a lower temperature at the lateral sides of the oven in contrast to the temperature directly in the center of the oven, because the oven's heat profile is greatest in the center and gradually diminishes toward the sides. Secondly, the airflow is pulled into the middle so that it most effectively cools the electronic 110 that are found in the middle of the bezel 30.

Now with reference to FIGS. 2 and 7, the rear wall 114 of the control panel bezel 30 has a relatively wide central air exhaust opening 120 in the form of a horizontal slot. In addition, a pair of exhaust openings 122 comprising smaller slots are formed to the right of the central opening 120. Looking down as in FIG. 2, these three exhaust openings 120, 122 generally span the front mouth 102 of the manifold 100. With the upper cooling fan 60 asymmetrically mounted at a rear left side of the housing 40, the added exhaust openings 122 to the right of the central opening 120 create a desirable air flow passage that reaches the components on the right hand side as well as in the middle of the oven. One option is to flip this air flow passage configuration (apply it to the left) which provides flexibility as to where the upper fan 60 is placed—i.e., on the left or right.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

It is claimed:

1. An oven having a control panel cooling system, comprising:

a) an oven including a housing having a front and rear and defining within a first insulated heating chamber having a front door therefor, the front door having an air flow channel extending from an opening in a lower edge to an opening in an upper edge;

b) a main air intake channel commencing at an opening toward the front of the housing and adjacent the opening in the upper edge of the door and extending to the rear of the housing;

c) a control panel bezel mounted above the door and enclosing therein electronics for the oven including on a front face thereof an LCD display with a capacitive glass touchscreen;

d) a secondary air intake channel commencing at a lower exhaust opening in a rear wall of the control panel bezel and extending to the rear of the housing;

e) an air exhaust channel open to an outlet of the cooling fan and having an exit from the housing located at a bottom of the housing; and f) a first cooling fan mounted within the rear of the housing outside of the first heating chamber arranged to pull air from both the main and secondary air intake channels and push air through the air exhaust channel and out of the exit so as to cool both the door and the electronics in the control panel bezel, and wherein the heating chamber includes convective flow outlets that open into the main air intake channel so that the cooling fan also pulls convective flow through the heating chamber.

2. The oven of claim 1, wherein the control panel bezel has upper air intake openings on both lateral sides of the rear wall.

3. The oven of claim 2, wherein the lower air exhaust opening is centrally located in the rear wall so that the air flow through the bezel commences at the upper lateral air intake openings and travels down and toward the center of the bezel.

4. The oven of claim 3, wherein the control panel bezel has two other lower air exhaust openings in the rear wall to one side of the central lower air exhaust opening, and the oven housing defines a horizontal manifold that has a relatively wide mouth adjacent the exhaust openings and narrows toward the rear and the cooling fan, the manifold defining the secondary air intake channel.

5. The oven of claim 1, wherein the housing also contains a second insulated heating chamber stacked below the first heating chamber, and the oven includes a second cooling fan mounted within the rear of the housing in a rear space open to a middle space defined between the first and second heating chambers, the second cooling fan being arranged to pull air both through the middle space and from the outlet of the first cooling fan mounted thereabove.

6. The oven of claim 1, wherein the electronics for the oven comprises retail-grade electronics for a standard tablet computer.

7. An oven having a control panel cooling system, comprising:

a) an oven including a housing defining within a first insulated heating chamber having a front door therefor, the front door having a door air flow path extending from an opening in a lower edge to an opening in an upper edge;

b) a control panel bezel mounted above the door and enclosing therein electronics for the oven including on a front face thereof an LCD display with a capacitive glass touchscreen, wherein the electronics for the oven comprises retail-grade electronics for a standard tablet computer, the control panel bezel having air intake openings and an air exhaust opening spaced therefrom defining a control panel bezel air flow path therebetween;

c) a first cooling fan mounted within and to the rear of the housing outside of the heating chamber;

d) separate air intake channels within the housing converging to an inlet of the cooling fan and arranged to pull air separately through both the door air flow path and control panel bezel air flow path; and e) an air exhaust channel open to an outlet of the cooling fan and having an exit from the housing.

8. The oven of claim 7, wherein the air intake openings of the control panel bezel are located on both upper lateral sides of a rear wall thereof.

9. The oven of claim 8, wherein the air exhaust opening of the control panel bezel is centrally located in a lower portion of the rear wall so that the air flow through the bezel commences at the upper lateral air intake openings and travels down and toward the center of the bezel.

10. The oven of claim 9, wherein the control panel bezel has two other lower air exhaust openings in the rear wall to one side of the central lower air exhaust opening, and the oven housing defines a horizontal manifold that has a relatively wide mouth adjacent the exhaust openings and narrows toward the rear and the cooling fan.

11. The oven of claim 7, wherein the heating chamber includes convective flow outlets that open into a flow channel above the heating chamber that is open to the door air flow path so that the cooling fan also pulls both convective flow through the heating chamber and cooling flow through the door air flow path.

12. The oven of claim 7, wherein the housing also contains a second insulated heating chamber stacked below the first heating chamber and having a second door with a second door air flow path, and the oven includes a second cooling fan mounted within the rear of the housing in a rear space open to a middle space defined between the first and second heating chambers, the middle space being open to the second door air flow path, the second cooling fan being arranged to pull air both through the middle space and from the outlet of the first cooling fan mounted thereabove.

13. The oven of claim 8, wherein the retail-grade electronics for the oven comprises components from a standard retail Android tablet.

14. An oven having a control panel cooling system, comprising:

a) an oven including a housing defining within at least one insulated heating chamber having a front door therefor;

b) a control panel bezel mounted above the door and enclosing therein retail-grade electronics for the oven including on a front face thereof a LCD display and capacitive glass touchscreen and corresponding circuitry, the control panel bezel having upper air intake openings on both lateral sides of a rear wall thereof and an air exhaust opening in the rear lower wall of the control panel bezel defining a control panel bezel air flow path therebetween, wherein the air exhaust opening of the control panel bezel is centrally located in the rear wall so that the air flow through the bezel commences to the upper lateral sides and travels down and toward the center of the bezel;

c) a first cooling fan mounted within and to the rear of the housing outside of the heating chamber;

d) an air intake channel commencing at the air exhaust opening of the control panel bezel and extending to an inlet of the cooling fan; and e) an air exhaust channel open to an outlet of the cooling fan and having an exit from the housing located at a bottom of the housing, such that f) operation of the fan pulls air through the air flow path of the control panel bezel and through the air intake channel, and pushes air through the air exhaust channel and out of the exit so as to cool the electronics in the control panel bezel.

15. The oven of claim 14, wherein the retail-grade electronics for the oven comprises components from a standard retail Android tablet.

16. The oven of claim 14, wherein the control panel bezel has two other lower air exhaust openings in the rear wall to one side of the central lower air exhaust opening, and the oven housing defines a horizontal manifold that has a relatively wide mouth adjacent the exhaust openings and narrows toward the rear and the cooling fan.

17. The oven of claim 14, wherein the oven front door has a door air flow path extending from an opening in a lower edge to an opening in an upper edge, and the first cooling fan is arranged to also pull air through the door air flow path, and wherein the heating chamber includes convective flow outlets that open into a flow channel above the heating chamber that is open to the door air flow path so that the cooling fan also pulls both convective flow through the heating chamber and cooling flow through the door air flow path.

18. The oven of claim 17, wherein the housing also contains a second insulated heating chamber stacked below the first heating chamber and having a second door with a second door air flow path, and the oven includes a second cooling fan mounted within the rear of the housing in a rear space open to a middle space defined between the first and second heating chambers, the middle space being open to the second door air flow path, the second cooling fan being arranged to pull air both through the middle space and from the outlet of the first cooling fan mounted thereabove.

19. An oven having a control panel cooling system, comprising:

a) an oven including a housing having a front and rear and defining within a first insulated heating chamber having a front door therefor, the front door having an air flow channel extending from an opening in a lower edge to an opening in an upper edge;

b) a main air intake channel commencing at an opening toward the front of the housing and adjacent the opening in the upper edge of the door and extending to the rear of the housing;

c) a control panel bezel mounted above the door and enclosing therein electronics for the oven including on a front face thereof an LCD display with a capacitive glass touchscreen;

d) a secondary air intake channel commencing at a lower exhaust opening in a rear wall of the control panel bezel and extending to the rear of the housing, wherein the control panel bezel has upper air intake openings on both lateral sides of the rear wall;

e) an air exhaust channel open to an outlet of the cooling fan and having an exit from the housing located at a bottom of the housing; and f) a first cooling fan mounted within the rear of the housing outside of the first heating chamber arranged to pull air from both the main and secondary air intake channels and push air through the air exhaust channel and out of the exit so as to cool both the door and the electronics in the control panel bezel.

20. The oven of claim 19, wherein the lower air exhaust opening is centrally located in the rear wall so that the air flow through the bezel commences at the upper lateral air intake openings and travels down and toward the center of the bezel.

21. The oven of claim 20, wherein the control panel bezel has two other lower air exhaust openings in the rear wall to one side of the central lower air exhaust opening, and the oven housing defines a horizontal manifold that has a relatively wide mouth adjacent the exhaust openings and narrows toward the rear and the cooling fan, the manifold defining the secondary air intake channel.

22. The oven of claim 19, wherein the housing also contains a second insulated heating chamber stacked below the first heating chamber, and the oven includes a second cooling fan mounted within the rear of the housing in a rear space open to a middle space defined between the first and second heating chambers, the second cooling fan being arranged to pull air both through the middle space and from the outlet of the first cooling fan mounted thereabove.

23. The oven of claim 19, wherein the electronics for the oven comprises retail-grade electronics.

24. The oven of claim 6, wherein the retail-grade electronics for the oven comprises components from a standard retail Android tablet.

* * * * *